US008231216B2

(12) United States Patent
Yamamuro et al.

(10) Patent No.: US 8,231,216 B2
(45) Date of Patent: Jul. 31, 2012

(54) PRINTING APPARATUS

(75) Inventors: Tomoki Yamamuro, Kawasaki (JP); Atsushi Sakamoto, Kawasaki (JP); Hitoshi Nishikori, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 12/651,591

(22) Filed: Jan. 4, 2010

(65) Prior Publication Data

US 2010/0189481 A1 Jul. 29, 2010

(30) Foreign Application Priority Data

Jan. 23, 2009 (JP) ..... 2009-013393

(51) Int. Cl.
*B41J 2/01* (2006.01)
*B41J 2/385* (2006.01)
*G03G 15/14* (2006.01)

(52) U.S. Cl. ..... 347/104; 347/153; 399/101

(58) Field of Classification Search ..... None
See application file for complete search history.

(56) References Cited

U.S. PATENT DOCUMENTS 4,992,834 A * 2/1991 Yamamoto et al. ..... 399/350
5,017,969 A 5/1991 Mitomi et al.
7,127,201 B2 * 10/2006 Takenouchi et al. ..... 399/297
2008/0107461 A1 * 5/2008 Miyata et al. ..... 399/343
2009/0148177 A1 * 6/2009 Nishisaka et al. ..... 399/71

FOREIGN PATENT DOCUMENTS

| | | |
|---|---|---|
| JP | 02-027383 | 1/1990 |
| JP | 11-020973 | 1/1999 |
| JP | 2000-337464 | 12/2000 |
| JP | 2002-023509 | 1/2002 |
| JP | 2004-136533 | 5/2004 |
| JP | 2004-244198 | 9/2004 |

* cited by examiner

*Primary Examiner* — Jerry Rahll
(74) *Attorney, Agent, or Firm* — Fitzpatrick, Cella, Harper & Scinto

(57) ABSTRACT

A printing apparatus comprises a conveyance belt configured to convey a printing medium while attracting the printing medium to a conveyance surface thereof using an electrostatic force, a printhead configured to discharge a printing material onto the printing medium conveyed by the conveyance belt, a blade configured to scrape the printing material adhering on the conveyance belt; a support unit configured to bring the blade into press contact with the conveyance belt, and a recovery unit configured to recover the printing material which is scraped by the blade and free-falls, wherein a pressure applied from the blade to the conveyance belt decreases from one end to the other end in an orthogonal direction perpendicular to a conveyance direction of the printing medium on the conveyance surface of the conveyance belt.

6 Claims, 4 Drawing Sheets

PRINTING APPARATUS

BACKGROUND OF THE INVENTION

1. Field of the Invention

The present invention relates to a printing apparatus.

2. Description of the Related Art

An inkjet type printing apparatus (to be simply referred to as an inkjet printing apparatus hereinafter) which discharges ink to form and print dots on a printing medium is known. Such a printing apparatus includes a conveyance mechanism which conveys a printing medium. The conveyance mechanism includes, for example, a conveyance roller and a pinch roller driven by it. Known examples of the conveyance method of the conveyance mechanism are a scheme in which a printing medium is conveyed while being pinched between the conveyance roller and the pinch roller, and a belt conveyance scheme in which a printing medium is conveyed together with a belt while being attracted to the belt. A known method of attracting a printing medium to a belt in the belt conveyance scheme is an electrostatic scheme in which a voltage is applied to a belt to attract a printing medium using the electrostatic force generated by the belt.

An inkjet printing apparatus often adopts the so-called mariginless print function of printing an image on the entire surface of a printing medium. In mariginless printing, ink is discharged to fall outside the edge of a printing medium by taking account of landing errors of the ink encountered when it lands on the printing medium. In view of this, it is often the case that when a printing apparatus which adopts the belt conveyance scheme performs mariginless printing, ink discharged to fall outside the edge of a printing medium contaminates the belt surface.

To combat this situation, cleaning mechanisms which remove the ink that causes such contamination are known. One cleaning mechanism scrapes the ink adhering on the conveyance belt by a blade. In the cleaning mechanism which uses a blade, the ink adhering on the blade undesirably solidifies when, for example, the printing apparatus has not been in use for a long period of time. This often results in a cleaning failure or a conveyance failure such as slipping of the conveyance belt attributed to an increase in its conveyance load. To prevent this, the technique described in Japanese Patent Laid-Open No. 2004-136533 brings the blade into contact with the conveyance belt from its lower side, and recovers the ink, scraped from the conveyance belt, by an absorbing member located on the lower side of the blade.

Also, in the belt conveyance scheme, the conveyance belt may shift and meander due to the adverse effect of factors associated with, for example, the parallelism between the driving roller and driven roller across which the conveyance belt is suspended, and a load imposed on the conveyance belt.

When such a shift of the conveyance belt occurs during a printing process, the actual landing points of the ink may deviate from its ideal landing points in an inkjet printing apparatus and this may degrade the print quality of the apparatus.

To tackle this situation, one known method forcibly suppresses meandering of the belt by disposing a flange serving as a regulating guide member and abutting the belt edge against the flange, as in the technique described in Japanese Patent Laid-Open No. 2004-244198. Another known method detects the amount of meandering of the belt and tilts the belt in accordance with the amount of meandering, as in the technique described in Japanese Patent Laid-Open No. 11-20973. Still another known method suppresses meandering of the belt by locating ribs in the inner periphery of the belt edge.

In this manner, most of various known methods of suppressing meandering of the belt exploit ribs. This is because an arrangement which exploits ribs is relatively simple and this leads to cost reduction and high reliability. However, when meandering is suppressed using ribs, a large stress acts on the ribs. As a result, the ribs may flake off or deform due to wear, or the roller may mount on the ribs due to downward bending of the belt edge. To prevent this, the technique described in Japanese Patent Laid-Open No. 2000-337464 reinforces the portion which receives a stress by adding a reinforcing material to the surface of the conveyance belt at the positions where ribs are present in the inner periphery of the edge of the conveyance belt.

As described above, when a printing medium is conveyed by the belt conveyance scheme, a conveyance failure may occur due to the presence of the ink adhering on the conveyance belt or meandering of the conveyance belt may occur due to a shift of the conveyance belt.

The mechanism disclosed in Japanese Patent Laid-Open No. 2004-136533 as a technique of removing the ink adhering on the conveyance belt still suffers from a problem associated with the situation in which the ink may not fall onto the absorbing member and so may remain on the blade when the amount of scraped ink is relatively small.

Also, the ribs disclosed in Japanese Patent Laid-Open No. 2000-337464 as a technique of suppressing meandering of the conveyance belt are located in the inner periphery of the conveyance belt on both its left and right sides, and this entails a cost higher than that required when a general conveyance belt is used. For cost reduction, another known method locates ribs in the inner periphery of the edge of the conveyance belt on its only one side. The technique described in Japanese Patent Laid-Open No. 2002-23509 locates members on the side on which ribs are located and its opposite side on the conveyance belt to maintain a given balance of the tension of the conveyance belt. Also, the technique described in Japanese Patent Laid-Open No. 2-27383 forms a groove at the same position as that where a rib is present. Still another known method, for example, prevents the conveyance belt from shifting toward the side on which the ribs are located on the conveyance belt. Nevertheless, this method requires separately providing a configuration for maintaining a given balance of the tension of the conveyance belt, and this entails a high cost. In this manner, when a printing medium is conveyed by the belt conveyance scheme, a technique of improving the recovery efficiency of the ink remaining on the blade, and suppressing meandering of the conveyance belt at low cost is desired.

SUMMARY OF THE INVENTION

The present invention provides a technique of efficiently recovering the ink cleaned out of a conveyance belt, and suppressing meandering of the conveyance belt while the cost is kept low.

According to an aspect of the present invention, there is provided a printing apparatus comprising: a conveyance belt configured to convey a printing medium while attracting the printing medium to a conveyance surface thereof using an electrostatic force; a printhead configured to discharge a printing material onto the printing medium conveyed by the conveyance belt; a blade configured to scrape the printing material adhering on the conveyance belt; a support unit configured to bring the blade into press contact with the conveyance belt; and a recovery unit configured to recover the printing material which is scraped by the blade and free-falls, wherein a pressure applied from the blade to the conveyance belt decreases from one end to the other end in an orthogonal direction perpendicular to a conveyance direction of the printing medium on the conveyance surface of the conveyance belt.

Further features of the present invention will become apparent from the following description of exemplary embodiments with reference to the attached drawings.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Preferred embodiments of the present invention will be described in detail below with reference to the accompanying drawings. In the following description, a printing apparatus using an inkjet printing method will be exemplified. The printing apparatus using the inkjet printing method may be, for example, a single-function printer having only a print function, or a multi-function printer having a plurality of functions including a print function, FAX function, and scanner function. Also, the printing apparatus using the inkjet printing method may be a manufacturing apparatus for manufacturing a color filter, electronic device, optical device, microstructure, or the like by the inkjet printing method.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Figure 1:
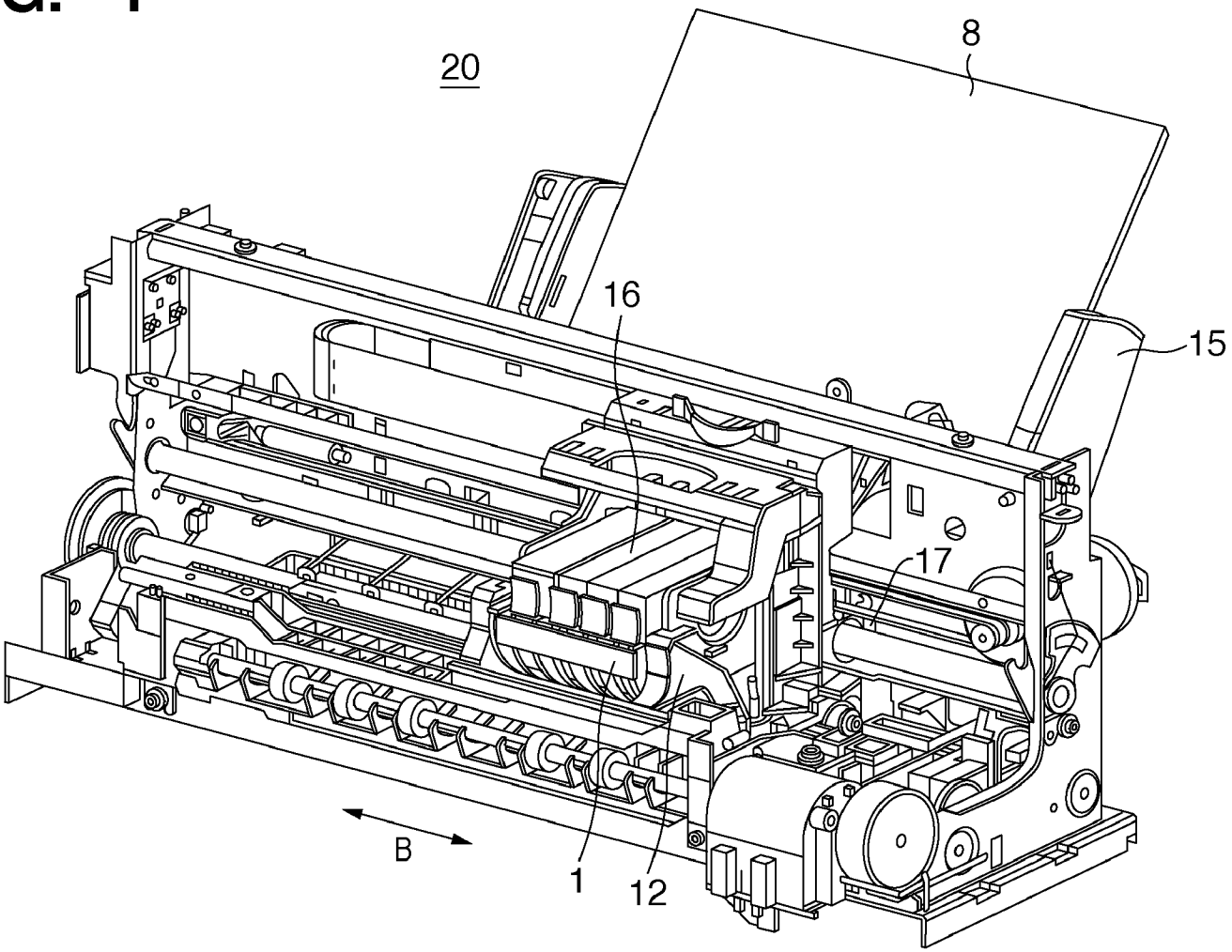
FIG. 1 is an external perspective view schematically showing the arrangement of a printing apparatus according to one embodiment of the present invention.

FIG. 1 is a perspective view showing an example of the outer arrangement of an inkjet printing apparatus 20 according to one embodiment of the present invention. Note that a conveyance belt and some members are not shown in FIG. 1 for the sake of easy explanation of the apparatus arrangement.

The inkjet printing apparatus (to be simply referred to as a printing apparatus hereinafter) 20 includes an inkjet printhead (to be simply referred to as a printhead hereinafter) 1 which is mounted on a carriage 12 and prints by discharging ink in accordance with the inkjet scheme. The carriage 12 is guided and supported to be slidable along a carriage shaft 17 in the direction indicated by a two-headed arrow B. The printing apparatus 20 prints by reciprocally moving the carriage 12 in the direction indicated by the two-headed arrow B. The printing apparatus 20 supplies a printing medium 8 such as a printing sheet via a sheet supply mechanism 15 and conveys it to the printing position. The printing apparatus 20 prints at the printing position by discharging ink from the printhead 1 to the printing medium 8.

The carriage 12 of the printing apparatus 20 mounts, for example, an ink cartridge 16, in addition to the printhead 1. The ink cartridge 16 stores ink to be supplied to the printhead 1. Note that the ink cartridge 16 is detachable from the carriage 12. The printing apparatus 20 shown in FIG. 1 can print in color. For this reason, the carriage 12 mounts four ink cartridges which respectively store magenta (M), cyan (C), yellow (Y), and black (K) inks. These four ink cartridges can be independently attached/detached.

The printhead 1 according to this embodiment adopts the inkjet scheme in which ink is discharged using thermal energy. For this reason, the printhead 1 includes electrothermal transducers. The electrothermal transducers are disposed in correspondence with respective discharge orifices, and a pulse voltage is applied to a corresponding electrothermal transducer in accordance with a printing signal. With this operation, ink is discharged from a corresponding discharge orifice.

Figure 2:
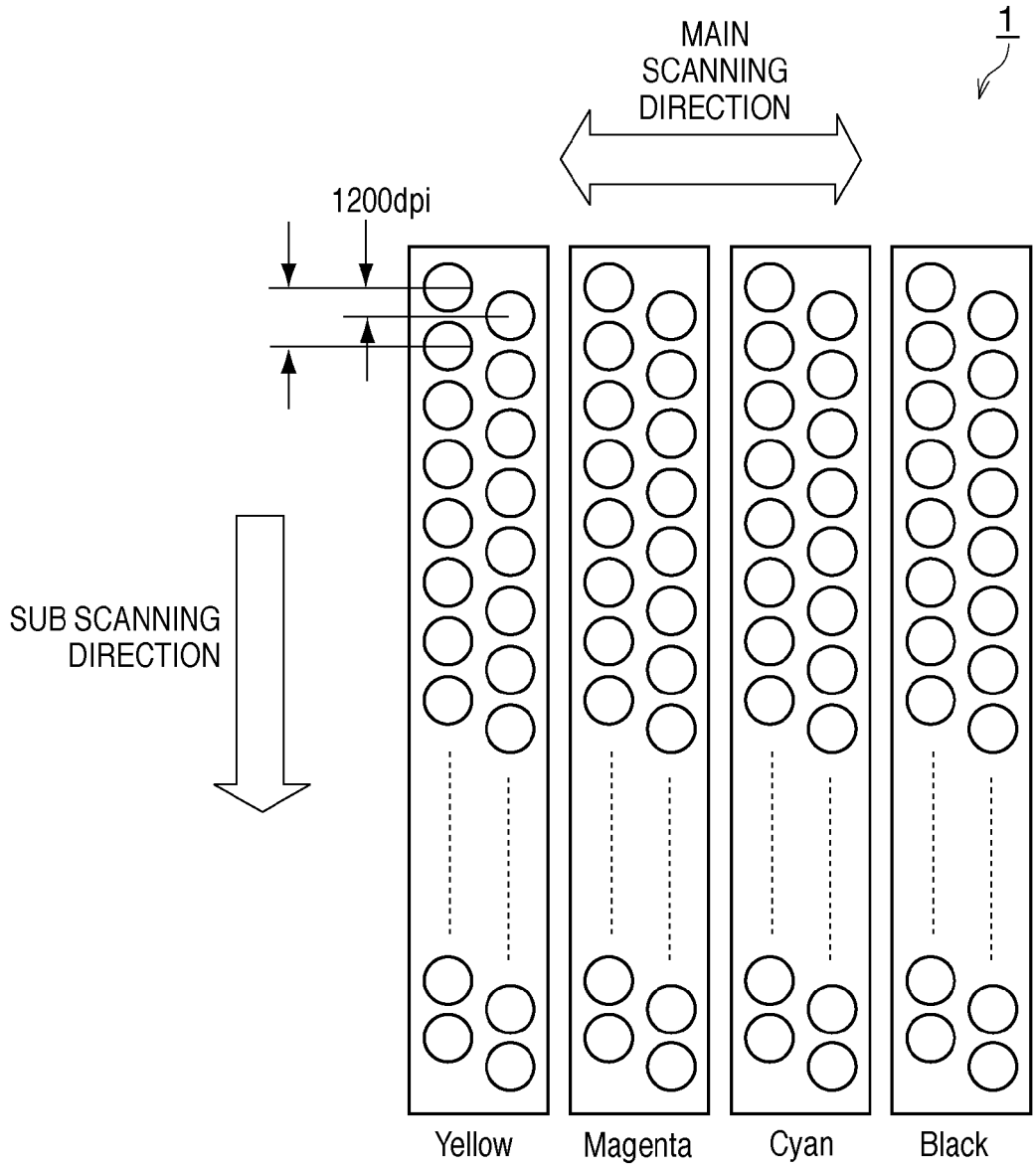
FIG. 2 is a schematic view illustrating an example of a printhead 1 according to the embodiment when viewed from the nozzle surface.

FIG. 2 is a schematic view illustrating an example of the printhead 1 shown in FIG. 1 when viewed from the nozzle surface. The printhead 1 according to this embodiment has inks of four colors: magenta (M), cyan (C), yellow (Y), and black (K), as described above. Nozzles for each color are arrayed in a staggered pattern, in which 256 nozzles are arrayed at an interval of 600 dpi in each of two columns and these two columns are shifted by 1,200 dpi. The direction in which nozzles are arrayed is the same as the sub scanning direction as the conveyance direction of a printing medium. Also, a direction (orthogonal direction) perpendicular to the direction in which nozzles are arrayed is the same as the main scanning direction in which the printhead reciprocates in the process of printing.

Figure 3:
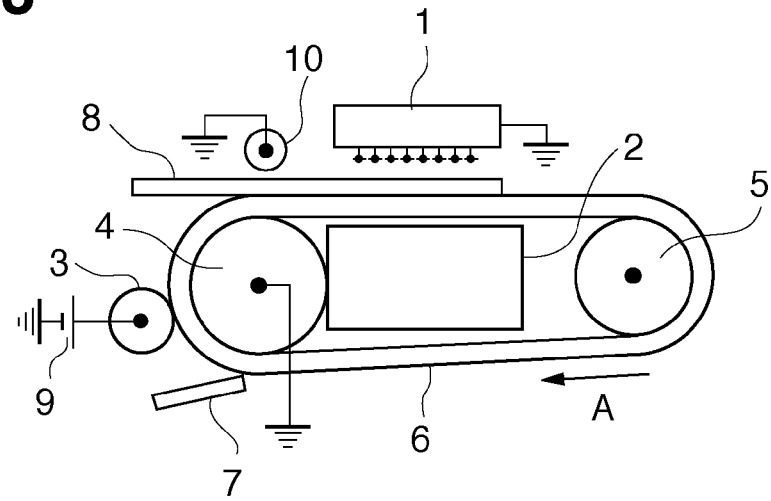
FIG. 3 is a side view illustrating an example of the arrangement of a conveyance unit of the printing apparatus according to the embodiment.
Figure 4:
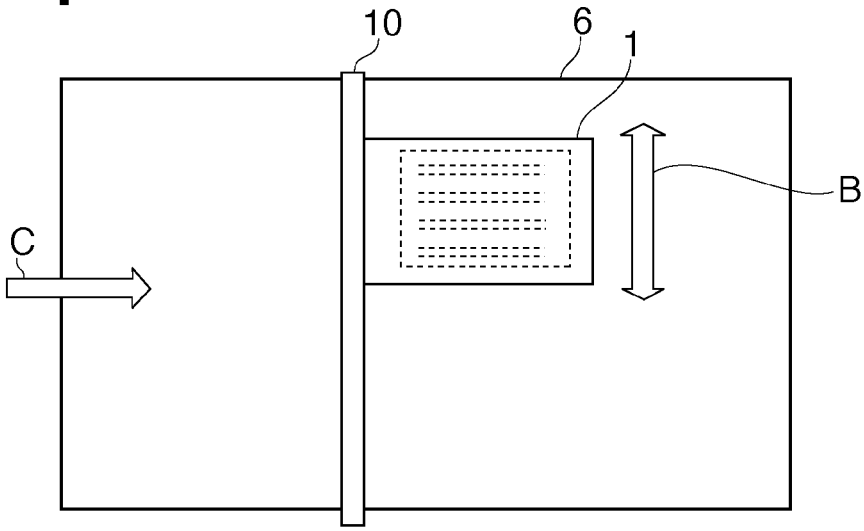
FIG. 4 is a plan view illustrating an example of the arrangement of the conveyance unit of the printing apparatus according to the embodiment.

An example of the arrangement of a conveyance unit of the printing apparatus 20 shown in FIG. 1 will be explained next with reference to FIGS. 3 and 4. FIG. 3 is a side view of the conveyance unit, and FIG. 4 is a plan view of the conveyance unit when viewed from immediately above. Note that the same reference numerals denote the same constituent elements throughout the drawings.

The conveyance unit according to this embodiment adopts the belt conveyance scheme in which the printing medium 8 is conveyed together with a conveyance belt 6 while being attracted to the conveyance belt 6. The conveyance unit includes a blade 7 as a cleaning mechanism. Reference numeral 1 denotes the printhead. In this case, the nozzle surface faces downward and therefore the nozzles discharge printing materials (inks in this case) downward. Referring to FIG. 4, the printhead 1 reciprocally moves assuming the direction indicated by a two-headed arrow B as the main scanning direction. The printhead 1 is mounted on the carriage 12. The carriage 12 is supported by the carriage shaft 17 and reciprocally scans along the carriage shaft 17.

Reference numeral 2 denotes a platen portion. A printing medium 8 is supplied from the sheet supply mechanism 15 and conveyed to a position immediately below the printhead 1. To maintain an appropriate ink discharge distance, the platen portion 2 suppresses vertical vibration of a portion immediately below the printhead 1 by supporting the printing medium 8 from below. Reference numeral 4 denotes a driving roller which drives the conveyance belt 6. Reference numeral 5 denotes a driven roller driven by the driving roller 4. Reference numeral 3 denotes a power feed roller which generates an electrostatic force to charge the conveyance belt 6. This is to attract the printing medium 8 to the conveyance belt 6. Reference numeral 9 denotes a potential difference generator which supplies charges to the power feed roller 3. The printing medium 8 is conveyed while the power feed roller 3 is in contact with the conveyance belt 6. With this mechanism, charges are supplied from the potential difference generator 9 onto the surface of the conveyance belt 6 to charge the surface of the conveyance belt 6.

In this arrangement, when the conveyance belt 6 rotates in the direction indicated by an arrow A, the printing medium 8 is conveyed at a constant speed. A pinch roller 10 is located on the upper side of the conveyance belt 6. A predetermined force acts on the pinch roller 10. When this takes place, the printing medium 8 conveyed while being pinched between the pinch roller 10 and the conveyance belt 6 is pressed against the conveyance belt 6, thereby attracting the printing medium 8 to the conveyance belt 6.

The blade 7 is a mechanism which cleans the conveyance belt 6 by scraping the ink adhering on it. The blade 7 is supported and brought into press contact with the conveyance belt 6 by a support unit (not shown). With this operation, the edge portion of the blade 7 reliably comes into contact with the conveyance belt 6. The blade 7 is brought into press contact with the driving roller 4 so as not to deform the conveyance belt 6. Although not shown, an absorbing member is located on the lower side of the blade 7 in FIG. 3 as an ink recovery unit. The ink scraped from the conveyance belt 6 by the blade 7 falls upon flowing over the blade 7 and is recovered by the absorbing member.

Figure 5:
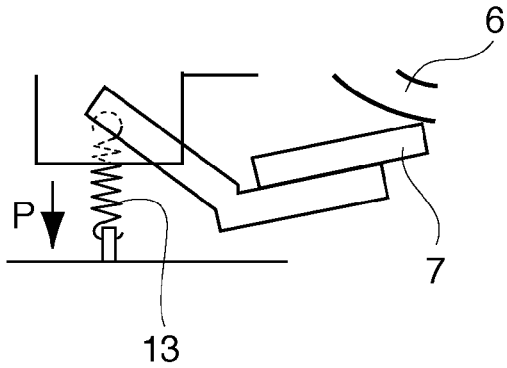
FIG. 5 is a view illustrating an example of the situation in which a blade 7 according to the embodiment is disposed.
Figure 6A:
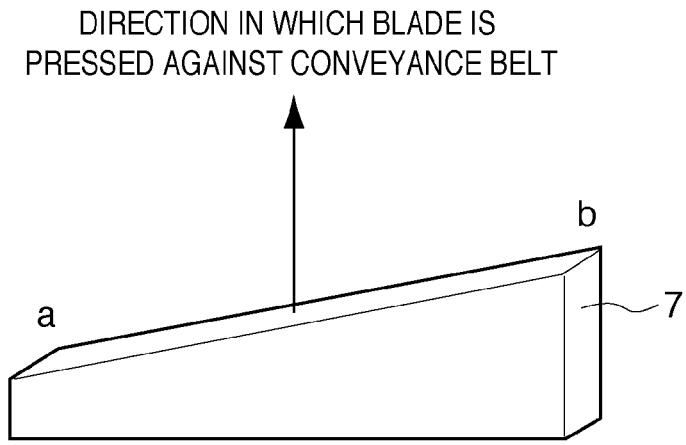
FIG. 6A is a view illustrating an example of the outer shape of the blade 7 according to the embodiment.

The blade 7 mentioned above will be described in detail herein with reference to FIGS. 5 and 6A.

An example of the support unit which brings the blade 7 into press contact with the conveyance belt 6 will be explained first with reference to FIG. 5. The blade 7 (the two proximal ends of the blade 7) is connected to one end of a spring 13. The other end of the spring 13 is connected to the printing apparatus 20. The spring 13 has a tensile force P in the downward direction in FIG. 5 (the direction toward the printing apparatus), and the edge portion of the blade 7 is pressed against the conveyance belt 6 in a counter configuration. When the conveyance belt 6 is conveyed in this state, the ink adhering on the conveyance belt 6 transfers onto the blade 7.

Figure 6B:
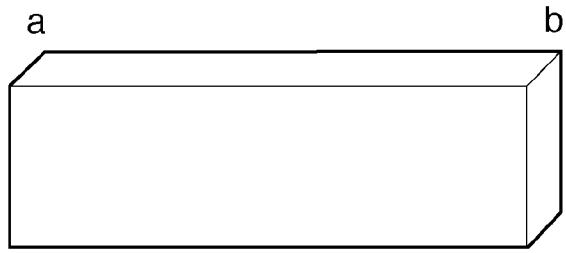
FIG. 6B is a view illustrating an example of the outer shape of a conventional parallel blade.

An example of the material and shape of the blade 7 will be explained next. FIG. 6A illustrates an example of the blade 7 according to the embodiment, and FIG. 6B illustrates an example of a conventional parallel blade.

The blade 7 is made of, for example, plate-like urethane rubber that allows the nip of the blade 7 to readily extend as the blade 7 comes into contact with the conveyance belt 6. This is to prevent the ink from slipping between the conveyance belt 6 and the blade 7. The blade 7 is formed in a hexahedron having a pair of parallel planes formed in a trapezoidal shape. The trapezoidal shape has its one side which connects the vertices of parallel opposite sides and forms angles other than a right angle with the opposite sides. In this case, the trapezoidal shape has its other side which connects the vertices of the parallel opposite sides and forms a right angle with the opposite sides. However, the angle between the other side of the trapezoidal shape and the opposite sides need not always be a right angle.

The blade 7 extends in a direction (main scanning direction) perpendicular to the conveyance direction (sub scanning direction) of the printing medium 8 on the conveyance surface of the conveyance belt 6. The pressure (pressing force) applied from the blade 7 to the conveyance belt 6 decreases (or increases) from one end to the other end in the main scanning direction. More specifically, the free length of the edge portion of the blade 7 at its one end is longer than that at its other end, as shown in FIG. 6A (the side on which the free length of the edge portion of the blade 7 is short is assumed as the side a and that on which that free length is long is assumed as the side b in this case). Hence, when the support unit presses the ends of the blade 7 on both the sides a and b against the conveyance belt 6 by equal forces, the pressure applied from the blade 7 to the conveyance belt 6 on the side b is stronger than that on the side a. Hence, the ink scraped from the conveyance belt 6 naturally moves to the side a on which the pressure applied from the blade 7 to the conveyance belt 6 is relatively weak. The above-mentioned absorbing member is located below the side a of the blade 7, and recovers the ink which is scraped by the blade 7 and free-falls upon flowing over the blade 7.

The ink recovery efficiency of the blade 7 according to this embodiment will be explained herein by comparison with a conventional parallel blade. More specifically, the results of building the blade 7 according to this embodiment shown in FIG. 6A and the conventional parallel blade shown in FIG. 6B into the printing apparatus and examining their characteristics involved will be explained herein.

The tensile forces of a spring are 1,400 grf on both the sides a and b. The conventional blade has a free length of 3 mm on both the sides a and b, whereas the blade 7 according to this embodiment has a free length of 3 mm on the side a and a free length of 3.5 mm on the side b.

Ink was uniformly directly sprayed onto the conveyance belt 6 by an atomizer and cleaned by the respective blades. When the conventional blade was used, the ink adhering on the blade spread from the side a to the side b. In contrast, when the blade 7 according to this embodiment was used, the ink moved to the side a on which the pressure is relatively weak.

In this manner, as long as the ink can be moved to one point on the blade 7 on the side a, the ink readily falls onto the absorbing member upon flowing over the blade 7 and therefore can be efficiently recovered. In this case, since an absorbing member need only be located on only the side a, the absorbing member can be downsized. With the above-described arrangement, the ink on the blade can be efficiently recovered by only changing the blade shape.

Figure 7:
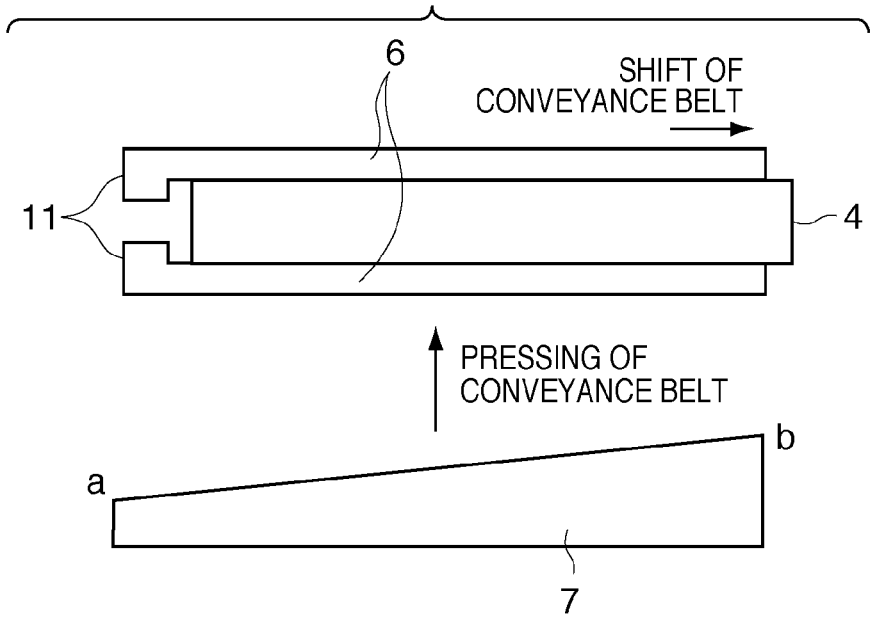
FIG. 7 is a plan view illustrating an example of a conveyance belt 6 according to the embodiment.

A measure against meandering of the conveyance belt 6 will be explained next. FIG. 7 is a view schematically illustrating an example of the conveyance belt 6 according to this embodiment.

The conveyance belt 6 includes ribs 11 located in its inner periphery on the side a on which the pressure of the blade 7 is relatively weak. As the conveyance belt 6 starts conveying a printing medium, it shifts toward the side b on which the pressure of the blade 7 is relatively strong but the ribs 11 forcibly suppress the shift. When the blade 7 according to this embodiment is used, the conveyance belt 6 shifts toward the side on which the pressure of the blade 7 is relatively strong because the magnitude of the pressure of the blade 7 differs between individual pressurized portions on the conveyance belt 6. Under the circumstance, meandering of the conveyance belt 6 can be suppressed as long as the ribs 11 are located on only the side on which the pressure acting on the conveyance belt 6 is relatively weak. Although a conventional method of locating ribs on only one side requires separately providing a configuration for preventing the conveyance belt from shifting toward the side on which the ribs are located, the arrangement according to this embodiment obviates the need for such a configuration. Hence, meandering of the conveyance belt can be suppressed while the cost is kept lower than that of the conventional arrangement.

As has been described above, according to this embodiment, the pressure acting on the conveyance belt is biased to either of the two ends of the edge portion of the blade to collect the ink, remaining in the edge portion of the blade, on the side on which the pressure is relatively weak. This makes it possible to prevent the ink scraped from the conveyance belt from remaining on the blade, thus improving the ink recovery efficiency.

When a blade having such an arrangement is used, it is also possible to suppress meandering of the conveyance belt by locating ribs in the inner periphery at its only one end at which the pressure of the blade is relatively weak. This, in turn, makes it possible to suppress meandering of the conveyance belt at a cost lower than that of the conventional arrangement.

Although an exemplary embodiment of the present invention has been described above, the present invention is not limited to the embodiment which is described above and shown in the drawings, and can be appropriately modified and practiced without departing from the spirit and scope thereof.

Although the above-described embodiment has exemplified a case in which the blade shape is changed in order to decrease (or increase) the pressure, applied from the blade to the conveyance belt, from one end to the other end, the present invention is not limited to this. This operation may be realized by, for example, pressing the conventional parallel blade against the conveyance belt at a predetermined angle with respect to a direction perpendicular to the conveyance direction of the conveyance belt. In this case as well, the pressure applied from the blade to the conveyance belt can be changed.

Although the above-described embodiment has exemplified a color printing apparatus, the same applies to a monochrome printing apparatus.

According to the present invention, it is possible to efficiently recover the ink cleaned out of the conveyance belt and suppress meandering of the conveyance belt while the cost is kept low.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-013393 filed on Jan. 23, 2009, which is hereby incorporated by reference herein in its entirety.

What is claimed is:

1. A printing apparatus comprising:

a conveyance belt configured to convey a printing medium while attracting the printing medium to a conveyance surface thereof using an electrostatic force;

a printhead configured to discharge a printing material onto the printing medium conveyed by said conveyance belt;

a blade configured to scrape the printing material adhering on said conveyance belt;

a support unit configured to bring said blade into press contact with said conveyance belt; and a recovery unit configured to recover the printing material which is scraped by said blade and free-falls, wherein a pressure applied from said blade to said conveyance belt decreases from one end to the other end in an orthogonal direction perpendicular to a conveyance direction of the printing medium on the conveyance surface of said conveyance belt.

2. The apparatus according to claim 1, wherein said blade is formed in a hexahedron having a pair of parallel planes formed in a trapezoidal shape.

3. The apparatus according to claim 2, wherein the trapezoidal shape has a side which connects vertices of parallel opposite sides and forms angles other than a right angle with the opposite sides, and said support unit brings a surface of said blade corresponding to a plane of said blade, which is perpendicular to a plane formed in the trapezoidal shape and includes the side that forms the angles other than the right angle with the opposite sides, into press contact with said conveyance belt.

4. The apparatus according to claim 2, wherein said support unit presses said blade against said conveyance belt by equal forces in an orthogonal direction perpendicular to the conveyance direction of the printing medium on the conveyance surface of said conveyance belt.

5. The apparatus according to claim 1, wherein said recovery unit is located at one end at which the pressure of said blade in the orthogonal direction is relatively weak.

6. The apparatus according to claim 1, wherein a rib is located in an inner periphery of said conveyance belt at one end at which the pressure of said blade is relatively weak.

* * * * *